US005746547A

United States Patent [19]

Reinmann et al.

[11] Patent Number: 5,746,547

[45] Date of Patent: May 5, 1998

[54] MINE SUPPORT CRIBS

[75] Inventors: John Joseph Reinmann, Alpharetta, Ga.; Clifford A. McCartney, Eighty-Four, Pa.

[73] Assignee: Strata Products, Inc., Atlanta, Ga.

[21] Appl. No.: 545,257

[22] Filed: Oct. 19, 1995

[51] Int. Cl.[6] ..... E21D 15/48

[52] U.S. Cl. ..... 405/288; 299/11; 405/273

[58] Field of Search ..... 405/272, 273, 405/288; 52/233; 299/11

[56] References Cited

U.S. PATENT DOCUMENTS

| | | | |
|---|---|---|---|
| 1,402,438 | 3/1922 | Nichols | 405/273 X |
| 2,190,556 | 2/1940 | Wiebecke et al. | 299/11 X |
| 2,832,100 | 4/1958 | Swallert . | |
| 4,840,003 | 6/1989 | Lucas et al. | 405/284 X |
| 4,997,315 | 3/1991 | Clark | 405/273 |
| 5,015,125 | 5/1991 | Seegmiller | 405/288 |
| 5,143,484 | 9/1992 | Deul | 405/288 |
| 5,435,670 | 7/1995 | Pienaar et al. | 405/289 |

FOREIGN PATENT DOCUMENTS

| | | | |
|---|---|---|---|
| 55-45953 A | 3/1980 | Japan | 405/273 |
| 85/2519 | 4/1985 | South Africa . | |
| 86/2467 | 4/1986 | South Africa . | |
| 91/1265 | 2/1991 | South Africa . | |
| 92/3628 | 5/1992 | South Africa . | |
| 93/4786 | 7/1993 | South Africa . | |
| 2270934 | 3/1994 | United Kingdom . | |
| WO 79/00567 | 8/1979 | WIPO . | |

OTHER PUBLICATIONS

Patent Journal, ZA-92/1677, Jan. 14, 1993.

*Primary Examiner*—Tamara L. Graysay
*Assistant Examiner*—Tara L. Mayo
*Attorney, Agent, or Firm*—Oblon, Spivak, McClelland, Maier & Neustadt, P.C.

[57] ABSTRACT

The invention is concerned with a mine support crib of the type which comprises a series of superimposed layers of elongate chocks. There is a plurality of parallel, spaced apart chocks in each layer with the chocks in one layer arranged transversely to the chocks in the adjacent layer or layers so that the chocks in a given layer, other than the bottom layer, cross the chocks in the layer below at crossing points which are located inwardly of the ends of the chocks. According to the invention, operatively upper and lower surfaces of the chocks are formed with notches at the crossing points. The notches interlock with one another to lock the chocks together. The notches are of such depth that portions of the chocks which are located between and beyond the notches bear on corresponding portions of chocks in the next layer but one below.

33 Claims, 6 Drawing Sheets

MINE SUPPORT CRIBS

BACKGROUND TO THE INVENTION

This invention relates to mine support cribs, otherwise termed mine support packs.

Cribs or packs are widely used in underground mines to provide yielding support for the hanging wall or roof of mine workings. They are usually constructed from lengths of timber, commonly referred to as chocks. The chocks are arranged in layers, with a series of parallel chocks in each layer and with the chocks in alternate layers being at right angles to the chocks in the layers above and below. The layers are assembled sequentially on the footwall or floor of the mine working, and a sufficient number of layers is assembled for the crib to extend a level close to the roof. Any gap between the uppermost layer and the roof can be taken up by insertion of timber wedges. Alternatively, with a view to placing the crib under initial preload, it is also known to interpose an inflatable grout bag between the uppermost layer and the roof. The grout bag is inflated into contact with the roof with a settable grout under pressure, with the result that the crib is preloaded in the vertical sense and is immediately placed in a condition to restrain the loads imposed thereon by the roof.

Many different crib configurations are known By way of example, in a typical "four-pointer" crib there are two chocks in each layer and a total of four points at which the chocks in one layer cross and bear upon the chocks in the layer beneath. In a "nine-pointer" crib, there are three chocks in each layer and hence a total of nine bearing points. Irrespective of the number of bearing points, it will be appreciated that in the simplest form of such cribs or packs the entire vertical load imposed by the roof must be transferred from one layer to the next via the bearing points, i.e. the points at which the chocks cross one another. The timber in each chock between the bearing points serves no real load-bearing function.

Attempts have been made to distribute the imposed loading by so-called "composite packs". Each chock in the pack has one or more bricks or blocks, typically cementitious or of timber, fixed to it at a predetermined position along its length. When the chocks are assembled to form, say, a four- or nine-pointer crib, the bricks are positioned between the chock-on-chock bearing points to transfer load to the chocks below. A typical example of a composite pack is described in the specification of South African patent 86/2467. The fixture of individual bricks or blocks to the chocks requires the separate manufacture of the bricks or blocks as well as an extra assembly step, and accordingly increases the overall cost of the crib or pack.

Conventional cribs or packs consisting of superimposed layers of chocks, with or without bricks or blocks as described above, also have the disadvantage that the chocks in one layer are prone to sideways slippage relative to the chocks in the layers above and below when the crib or pack is subjected to vertical loading.

In this connection it has been proposed, for instance in South African patent 93/4786, to notch the chocks at the positions where they cross one another, the notches to a certain extent interlocking with one another. However in the proposed arrangements the problem still remains that load must be transferred from one layer to the next only at the crossing or bearing points.

SUMMARY OF THE INVENTION

According to a first aspect of the present invention there is provided a mine support crib of the type which comprises:

a series of superimposed layers of elongate chocks, and a plurality of parallel, spaced apart chocks in each layer with the chocks in one layer arranged transversely to the chocks in the adjacent layer or layers so that the chocks in a superimposed layer cross the chocks in the layer below at crossing points which are located inwardly of the ends of the chocks, and wherein operatively upper and lower surfaces of the chocks in superimposed layers are formed with notches at the crossing points, the notches interlocking with one another to lock the chocks together, and the notches being of such depth that portions of the chocks which are located between and beyond the notches bear on corresponding portions of the chocks in the next layer but one below.

The chocks are typically of rectangular cross-section with flat upper and lower surfaces, and are preferably formed in one piece of timber, such as oak.

The crib may be, for instance, a four-pointer, nine-pointer or sixteen-pointer crib with two, three or four chocks in each layer and a total of four, nine or sixteen crossing points between adjacent layers. In the case of a four-pointer crib, the chocks have two notches in each of their upper and lower surfaces towards the ends of the chock. In the case of a nine-pointer crib, the chock have three notches in each of their upper and lower surfaces, two of the three notches being towards the ends of the chock and the remaining notch being mid-way along the length of the chock. In the case of a sixteen-pointer crib, the chocks have four notches in each of their upper and lower surfaces, an outer two of the notches being towards the ends of the chock and the remaining two notches being formed between the outer two notches.

According to another aspect of the invention there is provided a mine support for providing support for the roof of a mine working above the floor thereof, the mine support comprising:

a mine support crib which includes a series of superimposed layers of elongate chocks with a plurality of parallel, spaced apart chocks in each layer, the chocks in one layer being arranged transversely to the chocks in the adjacent layer or layers so that the chocks in a superimposed layer cross the chocks in the layer below at crossing points which are located inwardly of the ends of the chocks, and wherein operatively upper and lower surfaces of the chocks in superimposed layers are formed with notches at the crossing points, the notches interlocking with one another to lock the chocks together, and the notches being of such depth that portions of the chocks which are located between and beyond the notches bear on corresponding portions of the chocks in the next layer but one below; and an inflatable grout bag between the top layer of the crib and the roof, the grout bag being inflated with grout under pressure, thereby to place the crib under a compressive preload force.

According to yet another at of the invention there is provided an elongate chock for a mine support crib of the type comprising superimposed layers of elongate chocks, and a plurality of parallel, spaced apart chocks in each layer with the chocks in one layer arranged transversely to the chocks in the adjacent layer or layers so that the chocks in a superimposed layer cross over the chocks in the layer below at crossing points which are located inwardly of the ends of the chocks, wherein the chock is formed in one piece and has flat operatively upper and lower surfaces and, in each of the upper and lower surfaces, at least two notches which are located inwardly of the ends of the chock, the notches of the chock being arranged to interlock in use with the notches of the chocks in adjacent layers and the depth of the notches being such that portions of the chock which are located between and beyond the notches can bear on corresponding portions of a chock in the next layer but one below.

BRIEF DESCRIPTION OF THE DRAWINGS

The invention will now be described in more detail, by way of example only, with reference to the accompanying drawings in which.

DESCRIPTION OF THE INVENTION

Figure 1:
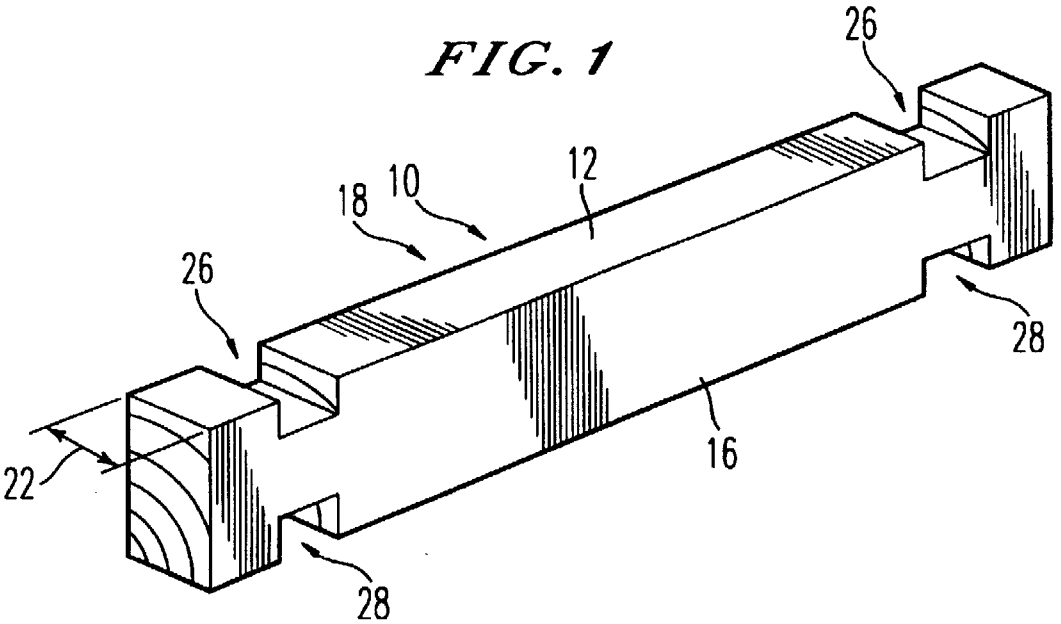
FIG. 1 shows a perspective view of a chock according to the invention which is to be used in the assembly of a four-pointer crib according to the invention.
Figure 2:
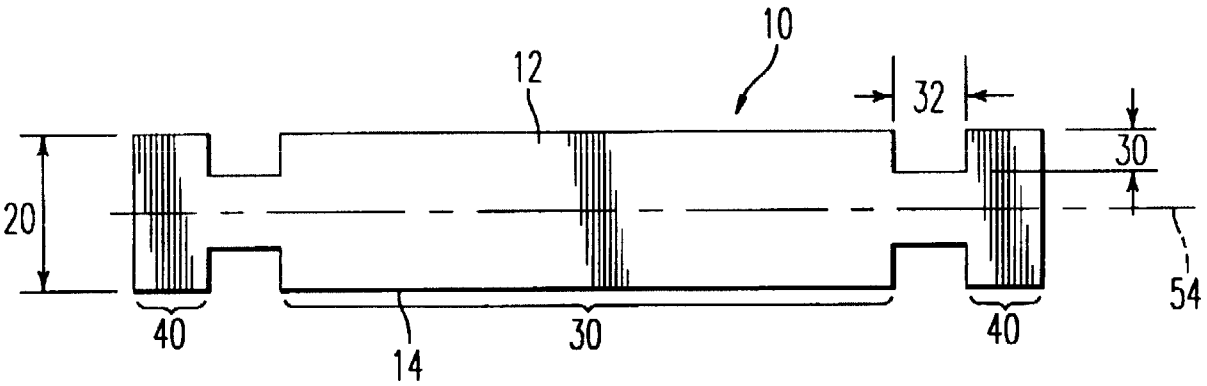
FIG. 2 shows a side view of the chock illustrated in FIG. 1.

In the accompanying drawings, FIGS. 1 and 2 illustrate a single chock 10 which is to be used in the construction of a mine support crib. The chock 10 is formed in one piece from a suitable timber, such as oak. As illustrated, the chock has an elongate shape and a rectangular cross-section providing flat upper and lower surfaces 12 and 14 respectively, and flat side surfaces 16 and 18 respectively. In this example, the height dimension 20 is 8 inches (approximately 200 nm), the width dimension 22 is 4 inches (approximately 100 mm) and the overall length dimension 24 is 28 inches (approximately 715 mm).

Two notches 26 are formed in the upper surface of the chock as illustrated. Identical notches 28 are formed in the lower surface of the chock. The notches 26, 28 are formed approximately 2 inches (approximately 50 mm) from the respective ends of the chock. The depth 30 of each notch, measured in a direction transverse to the length of the chock, may be approximately 25% of the height dimension of the chock and so will be approximately 2 inches (approximately 50 mm) for a height dimension 20 of 8 inches. The width 32 of the notch, measured along the length of the chock, will typically be approximately 4 inches (approximately 100 mm) or very slightly more.

Figure 3:
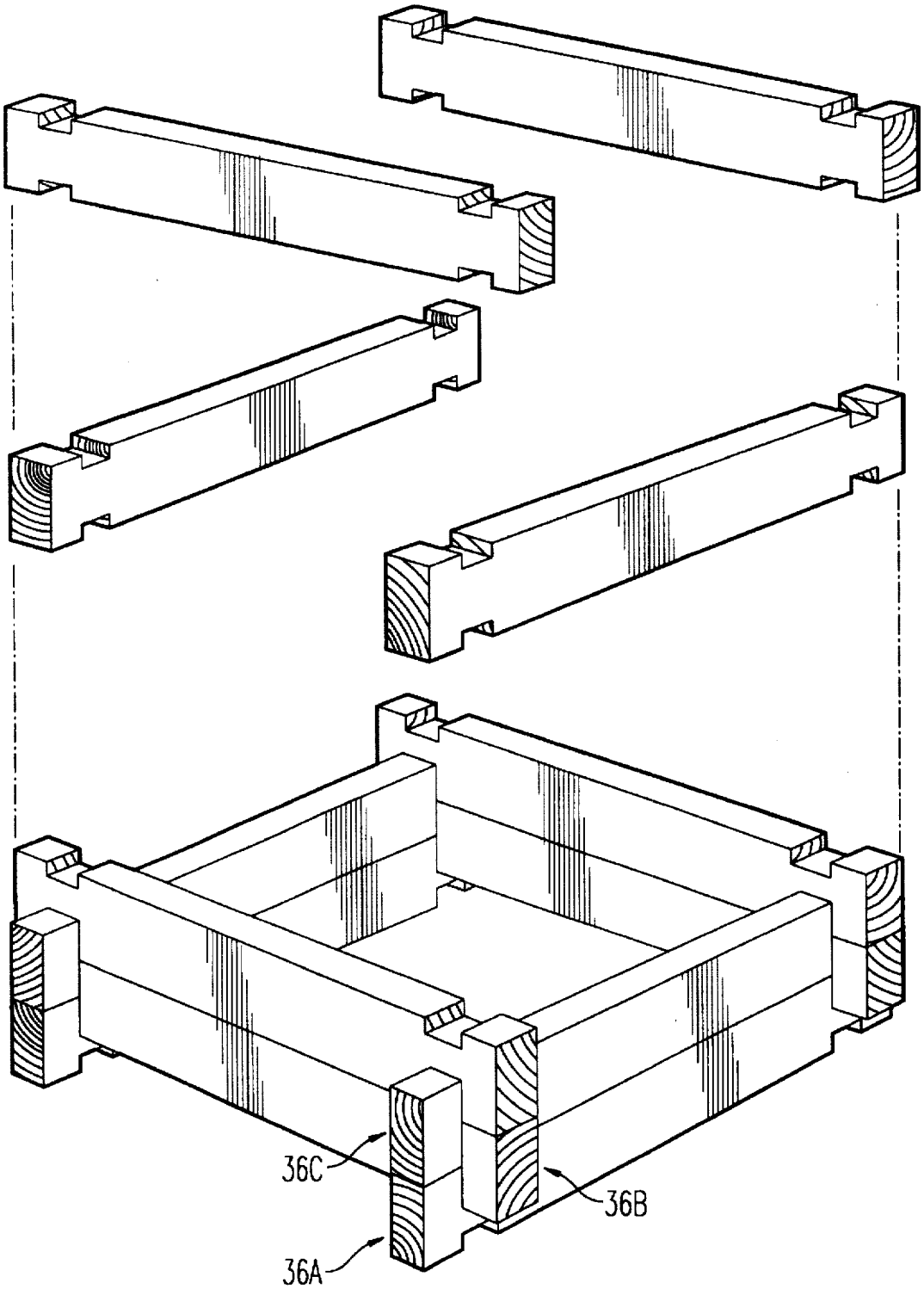
FIG. 3 illustrates the construction of a four-pointer crib according to the invention.
Figure 4:
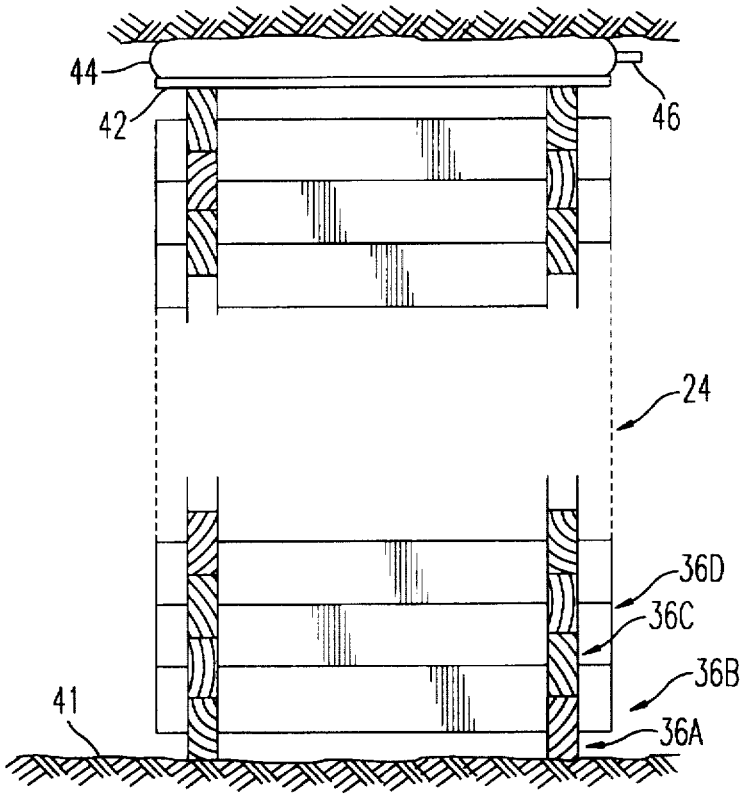
FIG. 4 illustrates an installed mine support according to the invention.

FIG. 3 illustrates the manner in which a series of identical chocks 10 is assembled to form a mine support crib 34 seen in FIG. 4. The crib 34 consists of superimposed layers 36A, 36B, 36C . . . of chocks 10, with two chocks in each layer and with the chocks in one layer at right angles to the chocks in the layers above and below. The arrangement of the chocks, is such that, at each crossing point where a chock in one layer crosses over a transverse chock in the layer immediately below, the notches of the crossed chocks interlock with one another.

In addition to mere interlocking of the notches with one another, the depth of the notches, which is constant throughout, is such that in the assembled crib, the central portion 38 of each chock which lies between the notches, as well as the end portions 40 of the chock which lie beyond the notches, bear continuously on the corresponding portions of the chock in the next layer down but one. In other words, the portions 38 and 40 of a chock in, say, the layer 36C will bear continuously upon the corresponding portions 38 and 40 of the aligned chock in the layer 36A, and so on. At the crossing points between chocks in adjacent layers, where the notches interlock with one another there is once again full timber on timber bearing with, for instance, the base of a notch 28 in a chock in the layer 36B bearing on the opposed base of a notch 26 in a chock in the next lower layer 36A.

Thus it will be seen that there is continuous bearing of each chock, over its full length, on chocks in the layers below. In the case of the bottom layer 36A, the lower surface 16 of each chock bears upon the floor 41 of the mine working.

FIG. 4 illustrates the completed mine support crib 34. The crib 34 extends from the floor to a position, established by the top layer, which is slightly beneath the roof. In the illustrated case, a headboard 42, typically constructed from timber planks, is laid over the chocks in the top layer, and an inflatable grout baby 44 is positioned between the headboard and the roof. The grout bag 44 is typically of the type sold under the trade mark "PACKSETTER" and includes an inner, liquid impervious bag located within an outer bag construction. The outer bag construction typically consists of two or three bags one inside the other and each made of woven polypropylene fibres. The outer bag construction provides strength and abrasion resistance for the inner bag.

An inflation nozzle 46 leading to the interior of the inner bag is accessible from outside the bag 44 and is fitted with a conventional non-return valve, typically a simple flap or ball valve. A grout pump is connected up to the noble and is used to inflate the bag 44 to a predetermined pressure. The inflation of the bag expands it into contact with the roof and applies a vertical preload force, the magnitude of which is dependent on the charging pressure, to the crib 34. The grout is allowed to set, thereby maintaining the imposed preload force. The preload force places the crib immediately in a condition to accept vertical loading from the roof. Any tendency of the mine working to close, i.e. for the roof to descend with time towards the floor, can be taken up by deformation of the timber chocks 10 making up the crib.

As an alternative to the use of an inflatable grout bag as described above, it is also within the scope of the invention for wedges or other filler elements to be driven forcibly between the top layer of the crib and the roof.

Referring again to FIG. 3 it will be appreciated that the chocks in the second layer 36B do not have a corresponding layer directly beneath them on which to bear, so the portions 38 and 40 of those chocks do not have continuous bearing as is the case with the chocks 10 in the higher layers. Should continuous bearing be required for the chocks in the layer 36B, filler chocks having notched upper surfaces and only half the height of a normal chock 10 can be used. The filler chocks, if used, are arranged to interlock with the chocks in the layer 36A. When so interlocked, the upper surfaces of the filler chocks are at the correct elevation to be contacted by the lower surfaces 14 of the chocks in the layer 36B, thereby establishing full bearing for the chocks in that layer.

Similarly, at the upper end of the crib, the chocks 10 in the layer second from the top have no timber bearing filly upon their upper edges. Filler chocks similar to those described above, but inverted, can be interlocked with the chocks 10 in the top layer to provide full bearing for the headboard. The filler chocks are dimensioned such that their upper surfaces are flush with the upper surfaces 12 of the chocks 10 in the top layer, thereby providing a flat and continuous bearing surface for the headboard.

Figure 8A:
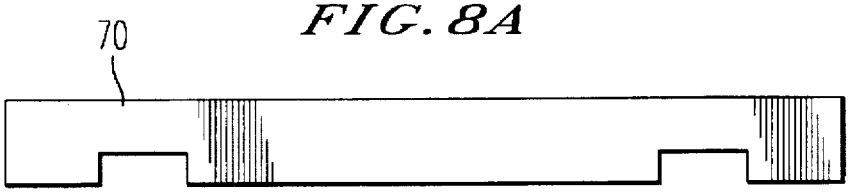
FIG. 8A illustrates a filler chock for the top layer of a four-pointer crib.
Figure 8B:
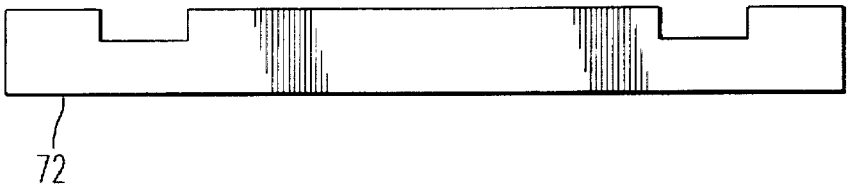
FIG. 8B illustrates a filler chock for the bottom layer of a four-pointer crib.

It will be appreciated that suitable filler chocks for the top and bottom layers could be manufactured merely by severing a chock 10 along its mid-plane, indicated in FIG. 2 by the numeral 54. A filler chock 70 for the top layer of a four-pointer crib is illustrated in FIG. 8A and a filler chock 72 for the bottom layer of a four-pointer crib is illustrated in FIG. 8B.

Figure 5:
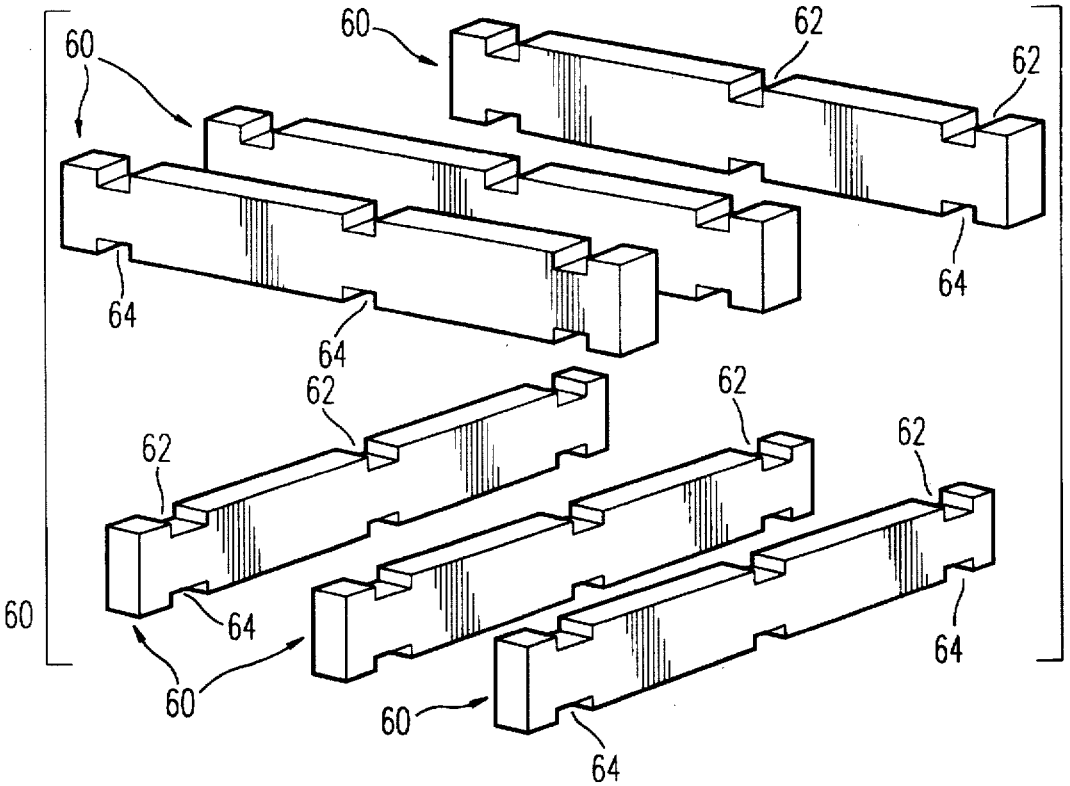
FIG. 5 illustrates the construction of a nine-pointer crib according to the invention.

FIG. 5 illustrates the first two layers of a nine-pointer crib which has three chocks in each layer. In this case, each chock 60 has three notches 62 in its upper surface and three identical notches 64 in its lower surface. The outer notches are positioned equidistantly from the ends of the chock and the inner notch is located centrally. Once again, it will be appreciated that full bearing for each chock can be obtained once the notches in the various layers are interlocked with one another. Filler chocks similar to those described above but with half the normal height and with three notches in the upper (or lower) surface can be used in the bottom and top layers if required.

The invention is equally applicable to sixteen-pointer cribs in which thee are four chock per layer, twenty-five pointer cribs in which there are five chocks per layer, and so forth. In each case, the notches will be equidistantly spaced from one another.

One major advantage of the cribs described and illustrated above is the fact that the interlocking of the notches effectively locks the chocks of the cribs together. There is accordingly little if any chance of the chocks sipping sideways relative to one another, and the crib is extremely stable. Because of their enhanced stability, cribs according to the invention may be substantially more slender than conventional cribs in which there is no interlocking for a given crib height. This in turn can reduce the volume of timber required to construct the crib.

Another major advantage is the fact that there is continuous bearing between the chocks over the full length thereof. Thus the imposed vertical load is transmitted through the crib over the the full length of each chock rather than merely at spaced apart points where the chocks cross over one another as in conventional crib constructions. Since the full length of each chock is involved in load transmission, the constructed crib is substantially stronger in compression than conventional cribs where the load concentrations at the bearing points may lead to early failure of the timber.

Figure 6:
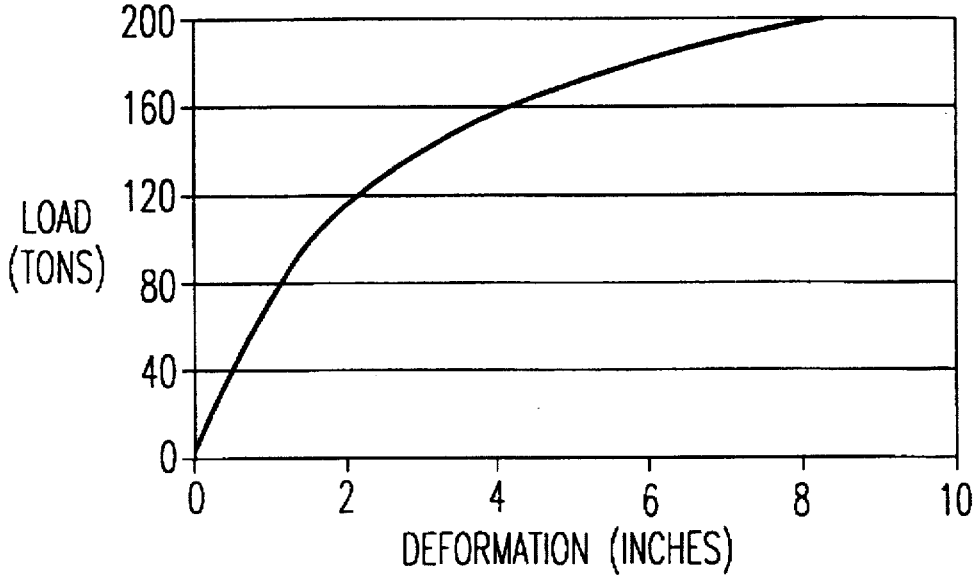
FIG. 6 graphically illustrates the predicted performance of a four-pointer crib according to the invention.
Figure 7:
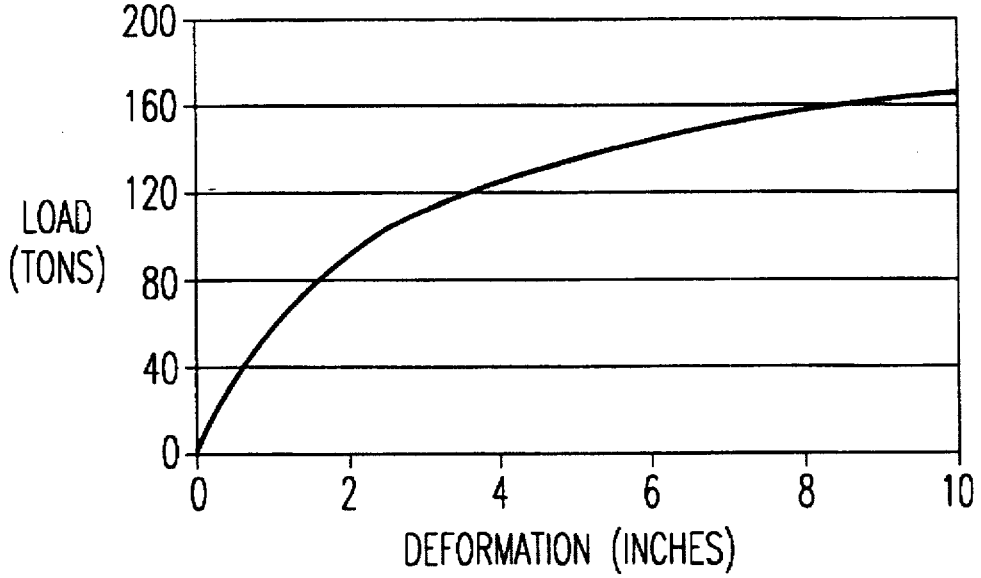
FIG. 7 graphically illustrates the predicted performance of another four-pointer crib according to the invention.

The above advantages which are obtained with cribs according to the invention are illustrated by the graphs of FIGS. 6 and 7 which illustrate the performance of two different four-pointer cribs as predicted by a computer model. The graphs of FIGS. 6 and 7 illustrate predicted crib performance under load with the applied load in tons on the vertical axis and deformation in inches on the horizontal axis.

In FIG. 6, the crib is composed of chocks with a width dimension of 4 inches, a height of 8 inches and a length of 28 inches. The assembled crib has an aspect ratio, i.e. slenderness ratio or ratio of overall height to transverse plan dimension, of 4.2. As predicted by the computer model the crib can be expected to withstand an imposed load of 117 tons at 2 inches of deformation and a load of 200 tons at 8 inches of deformation.

In FIG. 7, the crib is composed of chocks with a width dimension of 3 inches, a height of 8 inches and a length of 28 inches. The aspect ratio in this case is 4. As predicted by the computer model, the crib can be expected to withstand a load of 92 tons for 2 inches of deformation and a load of 169 tons for 10 inches of deformation.

In both cases, the predicted load bearing versus deformation characteristic is considered to be extremely favourable even though aspect ratios which would normally be considered excessive for conventional cribs are employed.

It will be appreciated that many variations are within the scope of the invention. For instance, although the illustrated chocks are machined to exactly rectangular cross-sections it is possible for the chocks to have other cross-sectional shapes. In one example, the chocks may be machined to have generally rounded sides with flat upper and lower surfaces. A generally rectangular shape will, however, normally be preferred to enable firm interlocking of chocks to be achieved.

Also, although the crib embodiments described above are square in plan shape, i.e. with chocks of the same length throughout, it will be appreciated that the principles of the invention are equally applicable to cribs which are rectangular in plan shape. In the latter case, the chocks in one layer will be longer than those in the intermediate layers.

Still father, while reference has been made to timber chocks, it is also within the scope of the invention for the chocks to be made of other materials, such as cementitious materials.

Figure 8C:
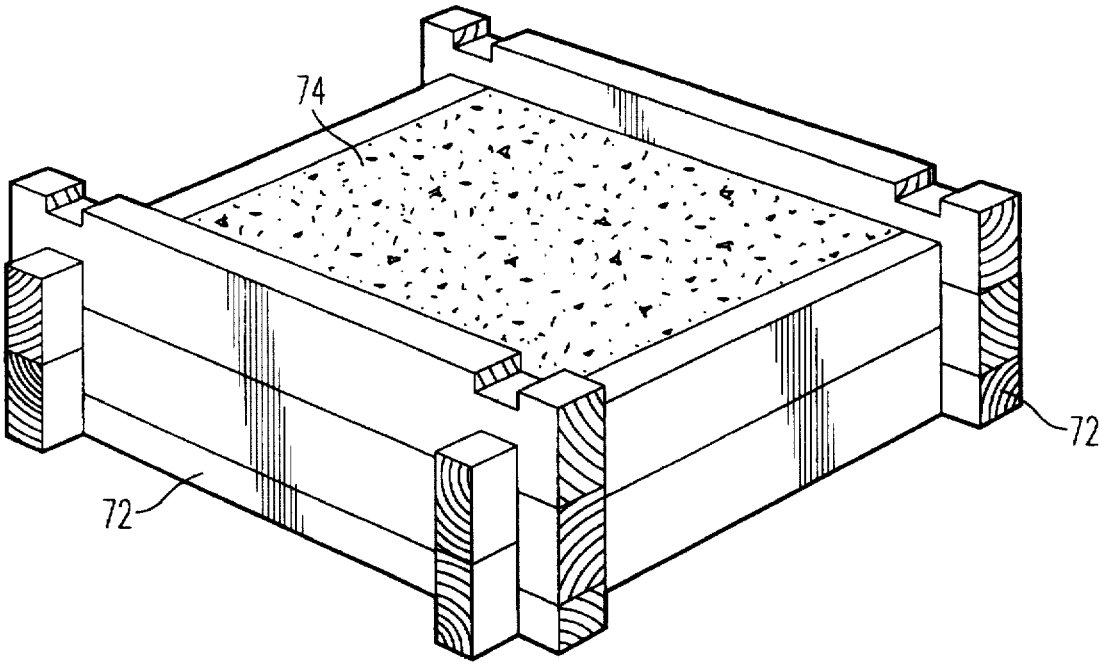
FIG. 8C illustrates a four-pointer crib filled with a settable material.
Figure 9:
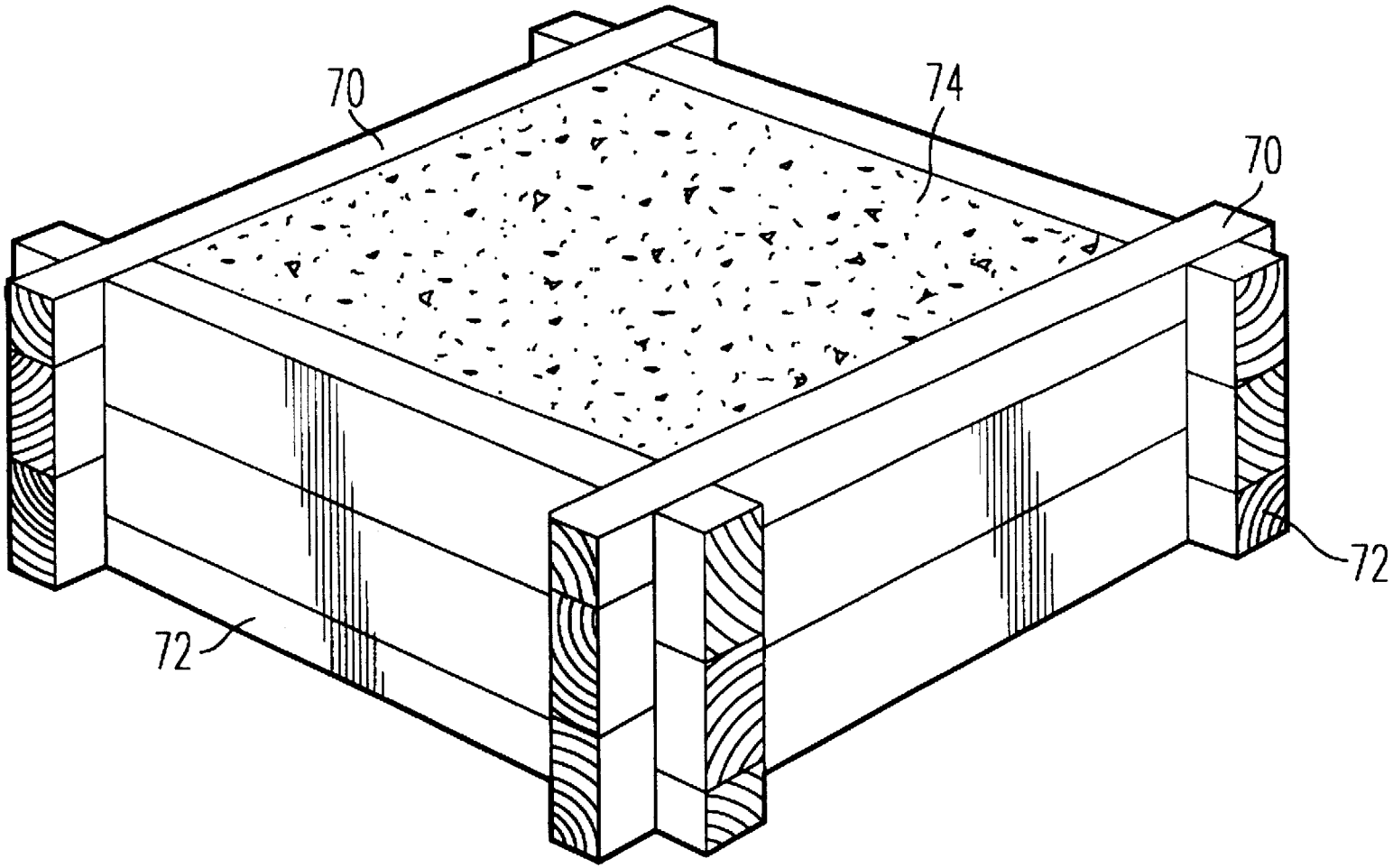
FIG. 9 shows another four-pointer crib filled with a settable material.

The invention also contemplates an arrangement in which the hollow central region of a crib, constructed in the manner described above, is filled with a settable material, typically a cementitious material, thereby forming a solid core. This is made possible by the fact that the chocks bear fully against one another so as to form a crib with generally continuous sidewalls through which there will be little if any leakage of the settable material prior to setting. It is envisaged that the internal core could be formed by pumping a settable material such as a cementitious mix or foam into the crib and allowing it to set as illustrated at 74 in FIG. 8C and FIG. 9. Irrespective of the manner in which the core is formed, it can be expected to increase the compressive strength of the assembled crib and it is believed that cribs of this type will be particularly useful in situations where a very rigid roof support is required. For extreme applications, it would even be possible to reinforce the core material, with steel or other reinforcement, if required.

It will be appreciated that in cases where a solid core is to be formed in the crib, it will be appropriate to make use of filler chocks, as discussed above, to seal the lower end of the crib before introduction of the settable material.

I claim:

1. A mine support providing support for the roof of a mine working above the floor thereof, the mine support comprising:

a mine support crib which includes a series of superimposed layers of elongate chocks with a plurality of parallel, spaced apart chocks in each layer, each chock in one layer being arranged transversely to each chock in the adjacent layer or layers so that the chocks in a superimposed layer cross the chocks in the layer below at at least two crossing points which are located inwardly of the ends of the chocks, and wherein operative upper and lower surfaces of the chocks in superimposed layers are formed with notches at the crossing points, the notches interlocking with one another to lock the chocks together, and the notches being of such depth that portions of the chocks which are located between and beyond the notches bear on corresponding portions of the chocks in the next layer but one below, and an inflatable grout bag adapted to be positioned between the top layer of the crib and a mine roof, the grout bag being inflated with grout under pressure, thereby to place the crib under a compressive preload force.

2. A mine support according to claim 1 wherein the chocks are of rectangular cross-section with flat operative upper and lower surfaces.

3. A mine support according to claim 2 wherein the crib is a four-pointer crib with two chocks in each layer and a total of four crossing points between adjacent layers, the chocks having two notches in each of their upper and lower surfaces towards the ends of the chock.

4. A mine support according to claim 2 wherein the crib is a nine-pointer crib with three chocks in each layer and a total of nine crossing points between adjacent layers, the chocks having three notches in each of their upper and lower surfaces, two of the three notches being towards the ends of the chock and the remaining notch being mid-way along the length of the chock.

5. A mine support according to claim 2 wherein each chock is formed in one piece of timber.

6. A mine support according to claim 1, wherein said mine support crib has a slenderness ratio equal to or greater than 4.

7. A mine support according to claim 6, wherein said mine support crib is capable of supporting a load equal to or greater than ninety-two tons.

8. A mine support according to claim 1, wherein said mine support crib has a slenderness ration of up to 4.2.

9. A mine support according to claim 7, wherein said mine support crib is capable of supporting a load equal to or greater than one-hundred seventeen tons.

10. A mine support according to claim 9 wherein said mine support crib defines a hollow central region, further comprising said hollow central region being filled with a settable material forming a solid core.

11. A mine support according to claim 1, further comprising bottom filler chocks each having a lower operative surface and an upper operative surface, said upper operative surface formed with notches at the at least two crossing points interlocking with notches in the lowermost layer of chocks which have notches on both the upper and lower operative surfaces, the lower operative surface of each bottom filler chock being flush with the lower operative surfaces of the chocks in the lowermost layer, the notches in the upper operative surface of said bottom filler chocks being of such depth that portions of the bottom filler chocks which are located between and beyond the notches provide support for the corresponding portions of the chocks in the next layer but one above.

12. A mine support according to claim 11 comprising top filler chocks each having a lower operative surface and an upper operative surface, said lower operative surface formed with notches at the at least two crossing points interlocking with the notches in the uppermost layer of the chocks which have notches in both the upper and lower operative surfaces, the upper operative surface of each top filler chock being flush with the top operative surface of the chocks in the uppermost layer, and the notches being of such depth that portions of the top filler chocks which are located between and beyond the notches bear on corresponding portions of the chocks in the next layer but one below.

13. A mine support according to claim 12 wherein said mine support crib defines a hollow central region, further comprising said hollow central region being filled with a settable material forming a solid core.

14. A mine support according to claim 12 wherein each notch has a base and the base of one notch of an interlocking pair of notches contacts the base of the other notch.

15. A mine support according to claim 11 wherein said mine support crib defines a hollow central region, further comprising said hollow central region being filled with a settable material forming a solid core.

16. A mine support according to claim 11 wherein each notch has a base and the base of one notch of an interlocking pair of notches contacts the base of the other notch.

17. A mine support according to claim 1 wherein each notch has a base and the base of one notch of an interlocking pair of notches contacts the base of the other notch.

18. A mine support comprising:

(a) a mine support crib including a series of superimposed layers of elongate chocks with a plurality of parallel, spaced apart chocks in each layer with the chocks in one layer arranged transversely to the chocks in the adjacent layer or layers so that each chock in a superimposed layer crosses the chocks in a layer below at at least two crossing points which are located inwardly of the ends of the chocks, and (b) wherein operative upper and lower surfaces of the chocks in superimposed layers are formed with notches at the at least two crossing points, the notches interlocking with one another to lock the chocks together, and the notches being of such depth that portions of the chocks which are located between and beyond the notches bear on corresponding portions of the chocks in the next layer but one below.

19. A mine support according to claim 18 wherein the chocks are of generally rectangular cross-section with flat upper and lower surfaces.

20. A mine support according to claim 19 wherein the crib is a four-pointer crib with two chocks in each layer and a total of four crossing points between adjacent layers, the chocks having two notches in each of their upper and lower surfaces towards the ends of the chock.

21. A mine support according to claim 19 wherein the crib is a nine-pointer crib with three chocks in each layer and a total of nine crossing points between adjacent layers, the chocks having three notches in each of their upper and lower surfaces, two of the three notches being towards the ends of the chock and the remaining notch being mid-way along the length of the chock.

22. A mine support according to claim 19 wherein each chock is formed in one piece of timber.

23. A mine support according to claim 18, wherein said mine support crib has a slenderness ratio equal to or greater than 4.

24. A mine support according to claim 23, wherein said mine support crib is capable of supporting a load equal to or greater than ninety-two tons.

25. A mine support according to claim 18, wherein said mine support crib has a slenderness ratio of up to 4.2.

26. A mine support according to claim 25, wherein said mine support crib is capable of supporting a load equal to or greater than one-hundred seventeen tons.

27. A mine support according to claim 18, further comprising bottom filler chocks each having a lower operative surface and an upper operative surface said upper operative surface formed with notches at the at least two crossing points interlocking with notches in the lowermost layer of chocks which have notches on both the upper and lower operative surfaces, the lower operative surface of each bottom filler chock being flush with the lower operative surfaces of the chocks in the lowermost layer, the notches in the upper operative surfaces of said bottom filler chocks being of such depth that portions of the bottom filler chocks which are located between and beyond the notches provide support for the chocks in the next layer but one above.

28. A mine support according to claim 27 comprising top filler chocks each having a lower operative surface and an upper operative surface, said lower operative surface formed with notches at the at least two crossing points interlocking with the notches in the uppermost layer of the chocks which have notches in both the upper and lower operative surfaces, the upper operative surface of each top filler chock being flush with the top operative surface of the chocks in the uppermost layer, and the notches being of such depth that portions of the top filler chocks which are located between and beyond the notches bear on corresponding portions of the chocks in the next layer but one below.

29. A mine support according to claim 28 wherein each notch has a base and the base of one notch of an interlocking pair of notches contacts the base of the other notch.

30. A mine support according to claim 27 wherein said mine support crib defines a hollow central region, further comprising said hollow central region being filled with a settable material forming a solid core.

31. A mine support according to claim 27 wherein each notch has a base and the base of one notch of an interlocking pair of notches contacts the base of the other notch.

32. A mine support according to claim 18 wherein each notch has a base and the base of one notch of an interlocking pair of notches contacts the base of the other notch.

33. A mine support kit comprising a plurality of elongate chocks, each elongate chock being formed in one piece and having flat operative upper and lower surfaces and, in each of the upper and lower surfaces, at least two notches which are located inwardly of the ends of the elongate chock, each notch of an elongate chock being arranged to interlock in use with a notch of another elongate chock and the depth of each notch being such that portions of the elongate chock which are located between and beyond the notches can bear on corresponding portions of an elongate chock in a layer but one below when said elongate chocks are arranged in layers to form a mine support crib, and a plurality of filler chocks, each filler chock being formed in one piece and having flat operative upper and lower surfaces and, on one of the upper and lower surfaces of the filler chocks, at least two notches which are located inwardly of the ends of the filler chocks, each notch in a filler chock being arranged to interlock in use with a notch of an elongate chock and the depth of the filler chock notches being such that portions of the filler chock which are located between and beyond the filler chock notches can bear on corresponding portions of an elongate chock in a layer second from the bottom or second from the top when the elongate chocks and the filler chocks are assembled to form a mine support crib, said elongate chocks having a length, a width, and a height, said filler chocks having a length, a width, and a height, the length and the width of the filler chocks being substantially equal to the length and the width of the elongate chocks, and the height of the filler chocks being substantially equal to one half of the height of the elongate chocks.

* * * * *